US010974932B2

(12) United States Patent
Tautz

(10) Patent No.: US 10,974,932 B2
(45) Date of Patent: Apr. 13, 2021

(54) METHOD AND PASSENGER CONVEYOR

(71) Applicant: KONE Corporation, Helsinki (FI)

(72) Inventor: Andreas Tautz, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 16/837,042

(22) Filed: Apr. 1, 2020

(65) Prior Publication Data

US 2020/0339389 A1 Oct. 29, 2020

(30) Foreign Application Priority Data

Apr. 23, 2019 (EP) ..... 19170548

(51) Int. Cl.
*B66B 25/00* (2006.01)
*B66B 21/04* (2006.01)
(Continued)

(52) U.S. Cl.
CPC ..... *B66B 25/003* (2013.01); *B66B 21/04* (2013.01); *B66B 23/02* (2013.01); *B66B 25/006* (2013.01); *B66B 29/00* (2013.01)

(58) Field of Classification Search
CPC ..... B65G 23/08; B65G 23/26; B65G 43/04; B65G 43/06; B66B 23/02; B66B 25/003; B66B 29/02
(Continued)

(56) References Cited

U.S. PATENT DOCUMENTS 4,047,452 A * 9/1977 Eddy ..... B65G 23/26 475/120
4,717,865 A * 1/1988 Caputo ..... B66B 25/00 188/171
(Continued)

FOREIGN PATENT DOCUMENTS

JP 2005-343625 A 12/2005
JP 2010-285273 A 12/2010

OTHER PUBLICATIONS

Extended European Search Report, issued in Priority Application No. 191705482, dated Oct. 25, 2019.

*Primary Examiner* — Joseph A Dillon, Jr.
(74) *Attorney, Agent, or Firm* — Birch, Stewart, Kolasch & Birch, LLP

(57) ABSTRACT

A method for controlling a passenger conveyor, which passenger conveyor includes an endless band of conveying elements, the endless band including an inclined conveying section; a drive shaft arranged to drive the endless band of conveying elements when rotated; a motor for rotating the drive shaft; a first sensing arrangement for sensing a rotation speed of the motor; a brake activatable to act directly on the drive shaft or an element fixedly connected to it for stopping rotation of the drive shaft; and a control system. The method includes rotating the drive shaft with the motor; and sensing rotation speed of the motor with the first sensing arrangement. The passenger conveyor includes a second sensing arrangement for sensing rotation speed of the drive shaft, and the method includes sensing rotation speed of the drive shaft with the second sensing arrangement; detecting deviation between the rotation speed of the motor and the rotation speed of the drive shaft or a multifold thereof; and activating the brake for stopping rotation of the drive shaft if deviation, in particular deviation meeting predefined criteria, is detected between the rotation speed of the motor and the
(Continued)

rotation speed of the drive shaft or a multifold thereof, wherein said multifold equals to the rotation speed of the drive shaft multiplied with a preset factor n, wherein n preferably equals to transmission ratio between the drive shaft and the motor. A passenger conveyor implementing the method is also disclosed.

20 Claims, 2 Drawing Sheets

(51) Int. Cl.
*B66B 23/02* (2006.01)
*B66B 29/00* (2006.01)

(58) Field of Classification Search
USPC ..... 198/323, 617, 832.2
See application file for complete search history.

(56) References Cited

U.S. PATENT DOCUMENTS 5,107,975 A * 4/1992 Iwata ..... B66B 29/02 198/323
5,277,278 A * 1/1994 Mehlert ..... B65G 43/06 188/70 B
6,334,522 B2 * 1/2002 Haruta ..... B66B 25/00 198/322
6,447,215 B1 * 9/2002 Wellmar ..... B65G 53/66 406/11
8,839,942 B2 * 9/2014 Tautz ..... B65G 43/04 198/323
9,440,800 B1 * 9/2016 Rimmington ..... F16D 7/02
10,207,874 B2 * 2/2019 Li ..... B65G 43/00
2001/0002644 A1 * 6/2001 Haruta ..... B66B 25/00 198/322
2002/0162726 A1 * 11/2002 Henkel ..... H02P 23/0077 198/330
2013/0228417 A1 9/2013 Tautz et al.
2014/0166434 A1 * 6/2014 Liang ..... B66B 25/00 198/322
2017/0297874 A1 10/2017 Borthakur et al.
2018/0186578 A1 * 7/2018 Li ..... B65G 23/44
2018/0244502 A1 * 8/2018 Henkel ..... B66B 25/003
2019/0089284 A1 * 3/2019 Ma ..... B66B 25/00

* cited by examiner

METHOD AND PASSENGER CONVEYOR

FIELD OF THE INVENTION

The invention relates to controlling a passenger conveyor, which passenger conveyor has an endless band of conveying elements, such as steps or pallets for instance, and an inclined conveying section. The passenger conveyor can be for instance an escalator or a moving ramp.

BACKGROUND OF THE INVENTION

Escalators and moving ramps are passenger conveyors, each of which typically comprises an endless band of conveying elements, such as steps or pallets for carrying the load to be transported, i.e. a person. A conveying element typically comprises guide rollers and a tread member with a tread surface on which a person can stand. The conventional passenger conveyors furthermore comprise elongated guide rails for guiding and supporting the guide rollers of the conveying elements. The conveying elements are typically connected to each other, most typically by a traction member such as a chain. In this case, the drive member can extend and couple with the conveying elements on one or both lateral sides of each conveying element, for instance. Alternatively, the conveying elements can be directly connected to each other, which is the case in some moving ramps particularly. In this case, a separate traction member may not be needed at all as the conveying members can transmit traction to each other directly.

A passenger conveyor of the aforementioned kind is typically arranged to divert the path of its moving parts at its upper and lower end by a pair of adjacent diverting wheels, such as sprocket wheels, which guide the drive member and the conveying elements to make a turn and return back towards the opposite end of the passenger conveyor. Typically, at least one end of the passenger conveyors the aforementioned sprocket wheels are also drive wheels, and for this purpose connected with a drive shaft driven by a motor, which in this manner drives the moving parts of the passenger conveyor via the drive shaft and the sprocket wheels.

For stopping movement of the conveying elements, the passenger conveyor typically comprises a main brake in connection with the motor. Some passenger conveyor have an auxiliary brake for preventing certain special conditions, and possibly to serve as a standstill brake. The auxiliary brake can be actuatable to act directly on the drive shaft or an element rigidly fixed thereon.

A possible safety risk in a passenger conveyor comprising an inclined section is that in case of a failure in the connection between the motor and the drive shaft, the band of conveying elements may start to rush in down direction owing to the weight of the passengers. Such a rushing may also be caused by a failure in some part of the machinery, such as failure of the main brake or failure of the motor encoder. In an event that a rushing occurs, due to high speed the passengers are not able to move away from the conveyor safely and in time, and they may fall about each other and get hurt. A drawback of the prior art is that failures that may cause this kind of situation has not been detected simply, early, reliably and quickly.

BRIEF DESCRIPTION OF THE INVENTION

The object of the invention is to introduce a new passenger conveyor and a method controlling the same, by which unsafe failures can be safely, simply, early, reliably and quickly detected and reacted to. An object is particularly to introduce a solution by which one or more of the above defined problems of prior art and/or drawbacks discussed or implied elsewhere in the description can be solved. It is brought forwards embodiments particularly by which a situation likely to lead to rushing of the passenger conveyor can be safely, simply, early, reliably and quickly detected and by which the situation can be prevented from getting worse.

It is brought forward a new method for controlling a passenger conveyor, which passenger conveyor comprises an endless band of conveying elements, such as steps or pallets for example, the endless band comprising an inclined conveying section, in particular for conveying passengers standing on the conveyor elements at an inclined angle upwards or downwards, and a drive shaft arranged to drive the endless band when rotated; a motor for rotating the drive shaft; a first sensing arrangement for sensing a rotation speed of the motor; a brake activatable to act directly on the drive shaft or an element fixedly connected to it for stopping rotation of the drive shaft; a control system; wherein the method comprises rotating the drive shaft with the motor; and sensing rotation speed of the motor with the first sensing arrangement. The passenger conveyor comprises a second sensing arrangement for sensing rotation speed of the drive shaft; and the method comprises sensing rotation speed of the drive shaft with the second sensing arrangement; and detecting deviation between the rotation speed of the motor and the rotation speed of the drive shaft or a multifold thereof; and activating the brake for stopping rotation of the drive shaft if deviation, in particular deviation meeting predefined criteria, is detected between the rotation speed of the motor and the rotation speed of the drive shaft or a multifold thereof, wherein said multifold equals to the rotation speed of the drive shaft multiplied with a preset factor n, wherein factor n preferably equals to transmission ratio between the drive shaft and the motor. With this kind of solution one or more of the above mentioned objects can be achieved. Particularly, hereby it is detectable whether the connection between the motor and the drive shaft has changed, e.g. due to failure of any of the components connecting them to each other, e.g. transmission components. Hereby, it is also provided that the system can monitor itself, since deviation caused by failure of either of the sensing arrangements can be used to trigger stopping of the passenger conveyor.

Preferable further details of the method are introduced in the following, which further details can be combined with the method individually or in any combination.

In a preferred embodiment, the passenger conveyor comprises one or more traction members, such as chains, on which the conveying elements are connected, and the drive shaft is arranged to drive the one or more traction members and thereby the endless band when rotated.

In a preferred embodiment, the passenger conveyor comprises a pair of drive wheels rotatable by the drive shaft, such as sprocket wheels, which drive wheels are arranged to drive the endless band when rotated, in particular directly acting on one or more traction members and/or on one or more conveying elements.

In a preferred embodiment, each of the aforementioned drive wheels is fixedly connected with the drive shaft.

In a preferred embodiment, said detecting comprises comparing a frequency of the motor with a frequency of the drive shaft.

In a preferred embodiment, said detecting comprises obtaining said frequency of the motor and the frequency of the drive shaft from signals received from the first sensing arrangement and the second sensing arrangement, respectively.

In a preferred embodiment, the method further comprises stopping rotation of the motor if deviation, in particular deviation meeting predefined criteria, is detected between the rotation speed of the motor and the rotation speed of the drive shaft or a multifold thereof.

It is also brought forward a new passenger conveyor comprising an endless band of conveying elements, such as steps or pallets, the endless band comprising an inclined conveying section, in particular for conveying passengers standing on the conveyor elements at an inclined angle upwards or downwards; a drive shaft arranged to drive the endless band when rotated; a motor for rotating the drive shaft; a first sensing arrangement for sensing a rotation speed of the motor; a brake activatable to act directly on the drive shaft or an element rigidly fixed thereon for stopping rotation of the drive shaft; and a control system. The passenger conveyor comprises a second sensing arrangement for sensing rotation speed of the drive shaft; and the control system is configured to detect deviation between the rotation speed of the motor and the rotation speed of the drive shaft or a multifold thereof, and to activate the brake for stopping rotation of the drive shaft if deviation, preferably deviation meeting predefined criteria, is detected between the rotation speed of the motor and the rotation speed of the drive shaft. or a multifold thereof, wherein said multifold equals to the rotation speed of the drive shaft multiplied with a preset factor n, wherein factor n preferably equals to transmission ratio between the drive shaft and the motor.

In a preferred embodiment, the control system is configured to compare a frequency of the motor with a frequency of the drive shaft for detecting said deviation. In a preferred embodiment, the control system comprises one or more microprocessors by aid of which the comparison is configured to be performed.

In a preferred embodiment, the control system is configured to stop rotation of the motor if deviation, in particular deviation meeting predefined criteria, is detected between the rotation speed of the motor and the rotation speed of the drive shaft or a multifold thereof.

In a preferred embodiment, the motor is connected with the drive shaft with transmission for transmitting rotation between an output shaft of the motor and the drive shaft, the transmission preferably comprising one or more gear wheels and/or a drive chain for transmitting rotation between an output shaft of the motor and the drive shaft. Transmission allows the motor to be placed relatively freely, and the rotation speed of the motor to be chosen relatively freely whereby size, structure and type of the motor can be more freely selected. The output shaft of the motor and the drive shaft are preferably oriented parallel to each other and disposed at distance from each other in their radial directions.

In a preferred embodiment, the element fixedly connected with the drive shaft is a wheel coaxial with the drive shaft.

In a preferred embodiment, the brake is a gripping device actuatable to grip said wheel fixedly connected with the drive shaft for stopping rotation thereof. Preferably, then the gripping device comprises two gripping members between which the wheel extends the gripping members being movable into contact with the wheel for braking rotation of the wheel. Generally, the gripping device can have different alternatives known in the field of disc brakes for instance. The gripping device can be a floating caliber brake for instance, whereby one of the gripping members can be stationary relative to a body of the gripping device for example. The gripping device may comprise a spring for urging gripping members of the gripping device towards a gripping state, i.e. towards each other so that they move towards the wheel between them, and an actuator such as a solenoid arranged to pull against the force of the spring the gripping members of the gripping device outwards from a gripping state, i.e. outwards from each other so that they are pulled outwards from the wheel between them.

In a preferred embodiment according to a first kind, said wheel fixedly connected with the drive shaft is a drive wheel rotatable by the drive shaft, such as a sprocket wheel, and arranged to drive the endless band when rotated, in particular directly acting on a traction member and/or the conveying elements thereof.

In a preferred embodiment according to a second kind, said wheel fixedly connected with the drive shaft is a braking wheel, preferably fixedly connected with the drive shaft in addition to a pair of drive wheels. In this case, preferably said wheel fixedly connected with the drive shaft is arranged not to serve as a drive wheel of the traction member and/or the conveying elements.

In a preferred embodiment, the second sensing arrangement for sensing a rotation speed of the shaft comprises one or more encoders. The one or more encoders are preferably devices known as rotary encoders.

In a preferred embodiment, the second sensing arrangement is arranged to generate and send to the control system signals having frequency proportional to the rotation speed of the drive shaft. This can be simply implemented by aid of one or more encoders for instance.

In a preferred embodiment, the second sensing arrangement, particularly preferably an encoder of the second sensing arrangement, comprises a rotatable member engaging the drive shaft such that it is rotatable by the drive shaft.

In a preferred embodiment, particularly related to a first kind of configuration, the aforementioned rotatable member is connected to the drive shaft such that they share a rotational axis. The aforementioned rotatable member is then preferably fixed to an axial end face of the drive shaft.

In a preferred embodiment, particularly related to a second kind of configuration, the aforementioned rotatable member is a wheel leaning against a rim of the drive shaft, the rotational axis of said wheel and the rotational axis of said drive shaft extending parallel at a distance from each other. Said wheel is preferably a friction wheel frictionally engaging the rim of the drive shaft. Said friction wheel preferably has a rim comprising elastomer material, such as rubber or polyurethane, for instance. Hereby, a frictional engagement is simply implemented.

In a preferred embodiment, the passenger conveyor comprises a pressing mechanism for pressing the rim of the rotatable member against a rim of the drive shaft. The mechanism can comprise one or more springs arranged to press the rotatable member against the drive shaft. This can be implemented such that said one or more springs are arranged urge (preferably push or alternatively pull) the body such that the rotatable member **6*a*** is pressed against the drive shaft.

In a preferred embodiment, the encoder of the second sensing arrangement comprises a non-rotatable body on which the rotatable member is mounted rotatably relative to the body. The encoder can be, for example, such that the sensor body is provided with one or more sensors arranged to sense one or more features of the rotatable member, and to generate and send signals to the control system.

In a preferred embodiment, the first sensing arrangement is arranged to generate and send to the control system signals having frequency proportional to the rotation speed of the motor. This can be simply implemented by aid of one or more encoders for instance.

In a preferred embodiment, the first sensing arrangement for sensing a rotation speed of the motor comprises one or more encoders.

In a preferred embodiment, the control system preferably stops/is configured to stop, rotation of the motor if a signal is received only from one of the first sensing arrangement and the second sensing arrangement by the control system.

In a preferred embodiment, the passenger conveyor is an escalator or a moving ramp.

In a preferred embodiment, the aforementioned traction member is a chain.

In a preferred embodiment, the drive wheel is a sprocket around and against which the traction member and/or conveying elements pass.

In a preferred embodiment, the passenger conveyor is an escalator and said conveying elements are steps.

In a preferred embodiment, each of the conveying elements comprises a tread member with a tread surface on which a person can stand while the conveying element moves.

In a preferred embodiment, the aforementioned criteria comprise that the deviation exceeds a threshold amount or that one of the rotation speed of the motor or the rotation speed of the drive shaft or a multifold thereof is zero when the other is non-zero, for example.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
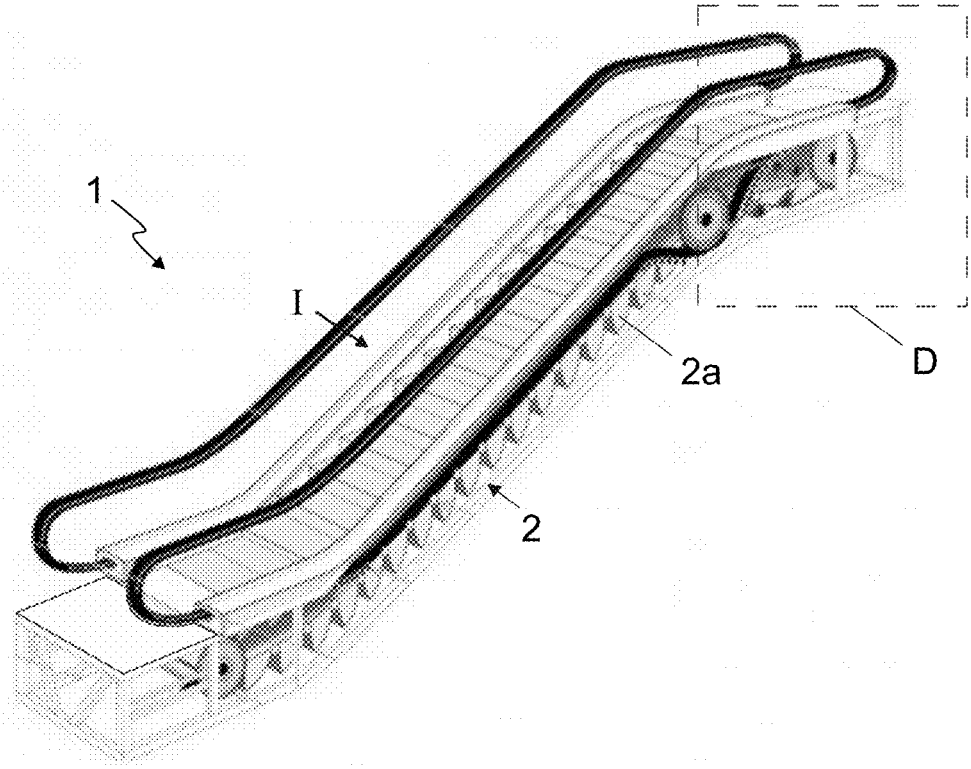
FIG. 1 illustrates a preferred embodiment of a passenger conveyor according to the invention.

FIG. 1 illustrates a passenger conveyor 1, in particular an escalator, comprising an endless band 2 of conveying elements 2*a*, the band 2 comprising an inclined conveying section I for conveying passengers standing on the conveyor elements 2*a* at an inclined angle upwards or downwards. The passenger conveyor 1 comprises a driven end D wherein the equipment for driving the passenger conveyor are placed. The passage of the band 2 of the conveying elements 3 is also diverted in the driven end D.

Figure 2:
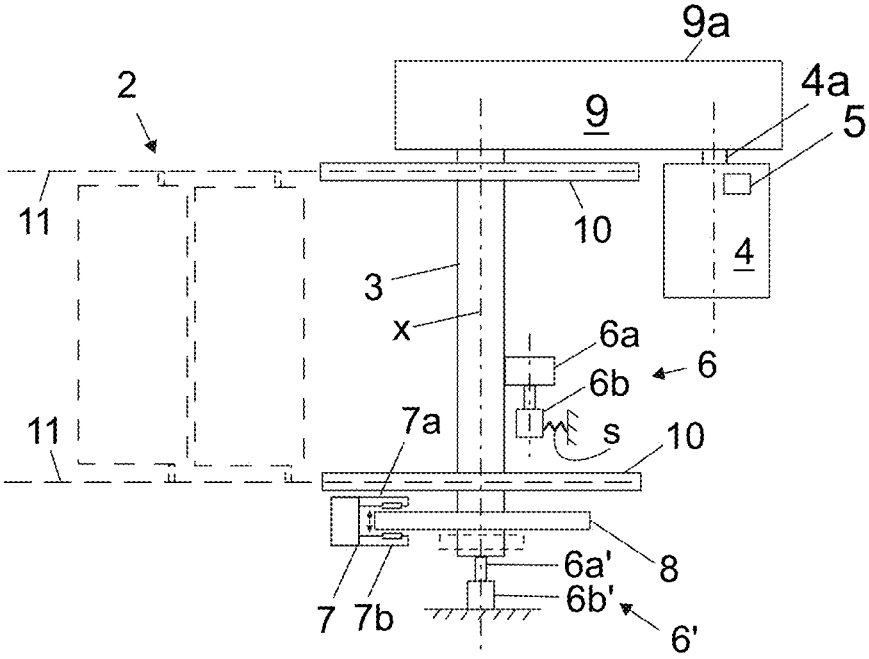
FIG. 2 illustrates preferred details of the passenger conveyor of FIG. 1 from above.
Figure 3:
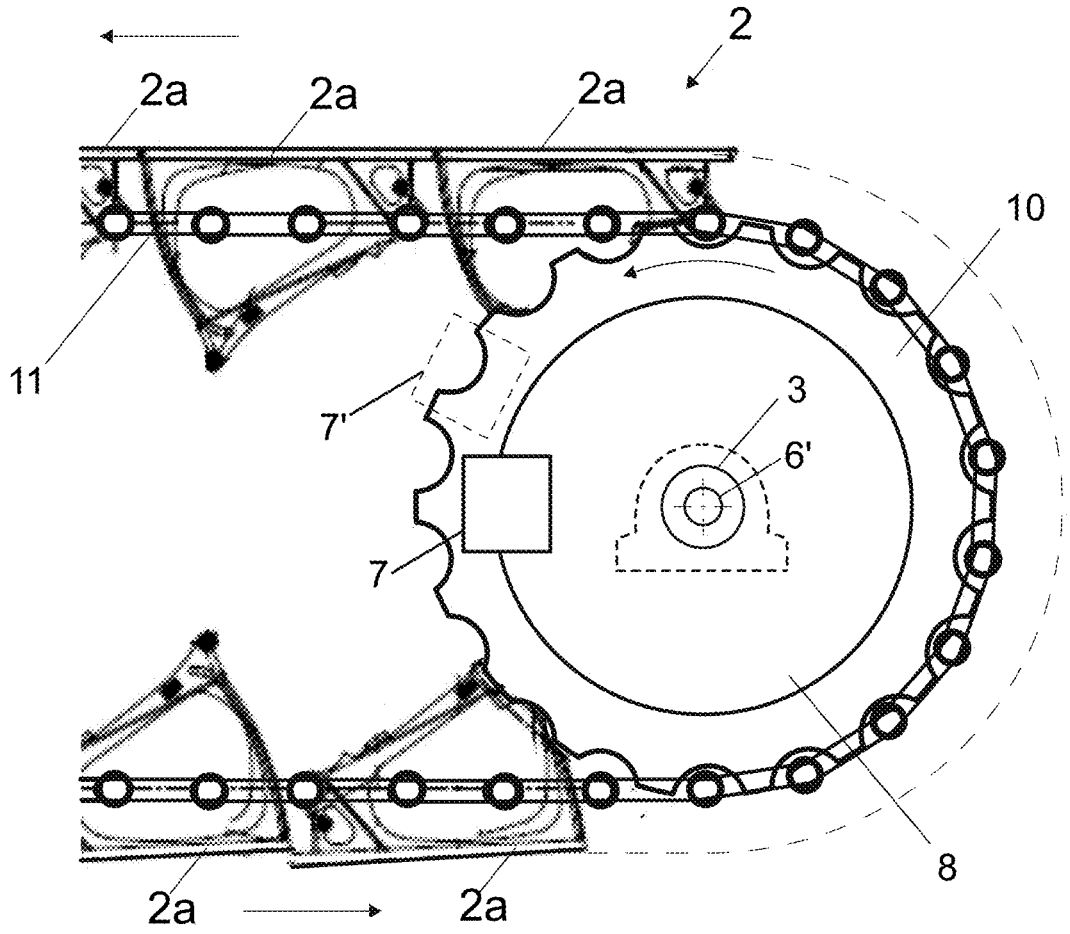
FIG. 3 illustrates the passenger conveyor of FIG. 1 from a side.

In the presented preferred embodiment, the passenger conveyor 1 is an escalator where the conveying elements 3 are connected to each other by two endless traction members 11, which is in the presented case are chains, as presented more precisely in FIGS. 2 and 3.

As visible in FIGS. 2 and 3, the passenger conveyor 1 comprises a drive shaft 3 arranged to drive the one or more traction members 11 and thereby the endless band 2 when rotated. The passenger conveyor 1 comprises a pair of drive wheels 10, which are in the preferred embodiment in the form of sprocket wheels, which drive wheels 10 are rotatable by the drive shaft 3, which drive wheels 10 are arranged to drive the endless band 2 when rotated, in particular directly acting on the traction members 11 and/or the conveying elements 2*a* thereof.

In the preferred embodiment, the drive wheels 10 are fixedly connected with the drive shaft 3.

The passenger conveyor 1 moreover comprises a motor 4 for rotating the drive shaft 3. The motor 4 is connected with the drive shaft 3 in a force transmitting manner, preferably via a transmission 9 as illustrated. The transmission 9 preferably comprises one or more gear wheels and/or a drive chain for transmitting rotation between an output shaft 4*a* of the motor 4 and the drive shaft 3. The transmission 9 may comprise a transmission housing 9*a* accommodating the aforementioned one or more gear wheels and/or a drive chain. The transmission 9 allows rotation speed of the output shaft 4*a* of the motor 4 and the drive shaft 3 differ, as well as provides freedom in choosing an optimal location for the motor 4. Transmission also brings components between the motor and drive shaft 3, whereby risk of failures increases, and thus in this context aspects of the invention are advantageous.

The passenger conveyor 1 moreover comprises a brake 7;7' activatable to act directly on the drive shaft 3 or an element 8;10 fixedly connected therewith for stopping rotation of the drive shaft 3. Thus, rotation of the drive shaft 3 can be stopped even in case motor 4, the brakes thereof, or the transmission 9 between the motor 4 and the drive shaft 3 fails to operate.

The passenger conveyor 1 moreover comprises a first sensing arrangement 5 for sensing a rotation speed of the motor 4; and a second sensing arrangement 6;6' for sensing rotation speed of the drive shaft 3; and a control system 9.

The method according to the invention comprises rotating the drive shaft 3 with the motor 4; and sensing rotation speed of the motor 4 with the first sensing arrangement 5, and sensing rotation speed of the drive shaft 3 with the second sensing arrangement 6;6'; and detecting deviation between the rotation speed of the motor 4 and the rotation speed of the drive shaft 3 or a multifold thereof; and activating the brake 7;7' for stopping rotation of the drive shaft 3 if deviation, in particular deviation meeting predefined criteria, is detected between the rotation speed of the motor 4 and the rotation speed of the drive shall 3 or a multifold thereof. The detecting is performed in the preferred embodiment by said control system 12.

In the aforementioned detecting, said multifold is preferably used particularly when the motor 4 indirectly drives the drive shaft 3, i.e. there is a transmission 9 between them. Said multifold preferably equals to the rotation speed of the drive shaft 3 multiplied with a preset factor n, wherein n preferably equals to transmission ratio between the drive shaft 3 and the motor 4.

Said detecting preferably comprises comparing a frequency of the motor 4 with a frequency of the drive shaft 3. Said frequency of the motor 4 and the frequency of the drive shaft 3 are obtained in the preferred embodiment from signals received from the first sensing arrangement 5 and the second sensing arrangement 6, respectively. Signals usable for this purpose can be simply generated by an encoder comprised in each of said first sensing arrangement 5 and the second sensing arrangement 6.

For enabling said comparing, the detecting preferably comprises obtaining the frequency of the motor 4 and the frequency of the drive shaft 3 from signals received from the first sensing arrangement 5 and the second sensing arrangement 6, respectively. Said obtaining can comprise processing and analyzing the signals received, if needed.

The method further comprises stopping rotation of the motor 4 if deviation, in particular deviation meeting predefined criteria, is detected between the rotation speed of the motor 4 and the rotation speed of the drive shaft 3 or a multifold thereof.

The passenger conveyor 1 according to the invention is configured to implement the method described above. The control system 12 of the passenger conveyor 1 is configured to detect deviation between the rotation speed of the motor 4 and the rotation speed of the drive shaft 3 or a multifold thereof, and to activate the brake 7;7' for stopping rotation of the drive shaft 3 if deviation, preferably deviation meeting predefined criteria, is detected between the rotation speed of the motor 4 and the rotation speed of the drive shaft 3 or a multifold thereof, wherein said multifold equals to the rotation speed of the drive shaft 3 multiplied with a preset factor n, wherein n preferably equals to transmission ratio between the drive shaft 3 and the motor 4.

In the preferred embodiment, the control system 12 is configured, preferably by aid of one or more microprocessors comprised in the control system 9, to compare a frequency of the motor 4 with a frequency of the drive shaft 3 for detecting said deviation. In the preferred embodiment, said frequency of the motor 4 and the frequency of the drive shaft 3 are arranged to be obtained from signals received from the first sensing arrangement 5 and the second sensing arrangement 6, respectively. Signals usable for this purpose can be simply generated by an encoder comprised in each of said first sensing arrangement 5 and the second sensing arrangement 6.

In the preferred embodiment, the control system 12 is configured to stop rotation of the motor 4 if deviation, in particular deviation meeting predefined criteria, is detected between the rotation speed of the motor 4 and the rotation speed of the drive shaft 3 or a multifold thereof.

In the preferred embodiment, the motor 4 is connected with the drive shaft 3 with transmission 9, the transmission 9 preferably comprising one or more gear wheels and/or a drive chain for transmitting rotation between an output shaft 4*a* of the motor 4 and the drive shaft 3.

As mentioned above, the brake 7,7' is activatable to act directly on the drive shaft 3 or an element 8;10 fixedly connected therewith for stopping rotation of the drive shaft 3. FIG. 2 illustrates two possible alternative positions for the brake 7,7', one shown in solid line and the other in broken line. In these alternatives, the brake 7,7' is activatable to act directly on the element 8,10 fixedly connected with the drive shaft 3, which element is in each of these cases a wheel 8 coaxial with the drive shaft 3.

According to the first preferred alternative, as illustrated in FIGS. 2 and 3, the brake 7 (drawn in solid line) is activatable to act directly on wheel 8, which is a braking wheel fixedly connected with the drive shaft 3 in addition to a pair of drive wheels 10. The braking wheel does not serve here as a drive wheel of the traction member and/or the conveying elements.

According to the second preferred alternative, as illustrated in FIG. 2, the brake 7' (drawn in broken line) is activatable to act directly on wheel 10, which is a drive wheel 10 rotatable by the drive shaft 3, in this case a sprocket wheel, which drive wheel 10 is arranged to drive the endless band 2 when rotated, in particular directly acting on a traction member 11 and/or the conveying elements 2*a* thereof.

The brake 7,7' is a gripping device actuatable to grip said wheel 8,10 for stopping rotation thereof, as illustrated. However, the brake could also be of some other kind, since gripping although advantageous, is not be necessary for achieving a braking action. The brake 7,7' in the form of a gripping device as illustrated, comprises two gripping members 7*a*, 7*b* between which the wheel 8, 10 extends the gripping members 7*a*, 7*b* being movable into contact with the wheel 8, 10 for braking rotation of the wheel 8, 10. The brake 7,7' in the form of a gripping device can be a floating caliber brake for instance, whereby one of the gripping members 7*a*,7*b* can be stationary relative to a body of the gripping device, for example. The brake 7,7' in the form of a gripping device is a device known as such, and used for instance in brakes systems of elevators. The brake 7,7' in the form of a gripping device can be for instance such that it comprises a spring for urging gripping members of the gripping device towards a gripping state, i.e. towards each other so that they move towards the wheel 8, 10 between them, and an actuator such as a solenoid arranged to pull against the force of the spring the gripping members of the gripping device outwards from a gripping state, i.e. outwards from each other so that they are pulled outwards from the wheel 8, 10 between them. This kind of operation principle provides a fail safe structure for the brake 7,7'.

In the method and the passenger conveyor 1 according to invention, said criteria preferably, although not necessarily, comprise that the deviation exceeds a threshold amount or that one of the rotation speed of the motor 4 or the rotation speed of the drive shaft 3 or a multifold thereof is zero when the other is non-zero, for example.

In the method and the passenger conveyor 1 according to invention, determination of whether said one or more criteria are met, is performed/configured to be performed by the control system 9.

In the method and the passenger conveyor 1 according to invention, preferably additionally, although not necessarily, the control system 12 stops/is configured to stop, respectively, rotation of the motor 4 if signals are received by the control system 12 only from one of the first sensing arrangement 5 and the second sensing arrangement 6.

In the method and the passenger conveyor 1 according to invention, preferably the second sensing arrangement 6;6' for sensing a rotation speed of the shaft 3 comprises one or more encoders 6*a*,6*b*;6*a*',6*b*'. Each said encoder 6*a*,6*b*;6*a*', 6*b*' is preferably a rotary encoder.

FIG. 2 illustrates two possible alternative configurations for the encoder 6*a*,6*b*;6*a*',6*b*' of the second sensing arrangement 6;6'. In each of these alternatives, the encoder 6*a*,6*b*; 6*a*',6*b*' of the second sensing arrangement 6;6' comprises an a rotatable member 6*a*;6*a*' engaging the shaft 3 such that it is rotatable by the shaft 3. The encoder 6*a*,6*b*;6*a*',6*b*' of the second sensing arrangement 6;6' moreover comprises a non-rotatable body 6*b*;6*b*' on which the rotatable member 6*a*;6*a*' is mounted rotatably relative to said body 6*b*;6*b*'. The encoder 6*a*,6*b*;6*a*',6*b*' is arranged to generate and send signals to the control system 12 indicating rotation speed of the shaft 3.

The signals of the encoder 6*a*,6*b*;6*a*',6*b*' generated and sent to the control system 12 have preferably frequency proportional to the rotation speed of the drive shaft 3. The encoder 6*a*,6*b*;6*a*',6*b*' can for instance comprise one or more sensors mounted on a non-rotatable body 6*b*;6*b*' arranged to sense one or more features of the rotatable member 6*a*;6*a*', and to generate and send a signal to the control system, every time a feature to be sensed passes by it.

Figure 4:
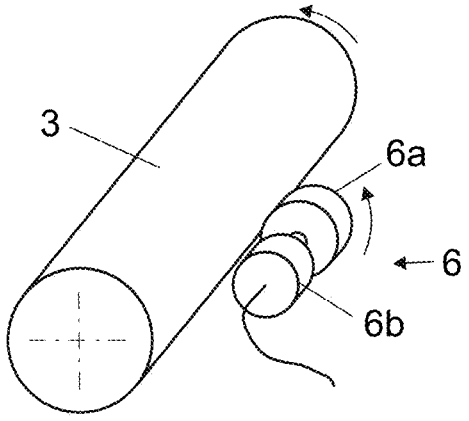
FIG. 4 illustrates preferred details one preferred configuration for the second sensing arrangement.

According to the first preferred alternative, as illustrated in FIGS. 2 and 4, the rotatable member 6*a* is a wheel leaning against a rim of the drive shaft 3, the rotational axis of said wheel 6*a* and said shaft 3 extending parallel at a distance from each other. Said wheel 6*a* is preferably a friction wheel frictionally engaging the drive shaft 3. Said friction wheel preferably has a rim comprising elastomer material, such as rubber or polyurethane, for instance. Hereby, a frictional engagement is simply implemented. The frictional engagement can be facilitated by providing an pressing mechanism for pressing the rim of the rotatable member 6*a* against a rim of the drive shaft 3. The mechanism can comprise one or more springs s arranged to press the rotatable member 6*a* against the drive shaft 3. This can be implemented such that said one or more springs s are arranged urge (preferably push or alternatively pull) the body 6*b* such that the rotatable member 6*a* is pressed against the drive shaft 3.

According to the second preferred alternative, as illustrated in FIGS. 2 and 3, the rotatable member 6*a*' is fixed on the drive shaft 3 such that they share a rotational axis x. The rotatable member 6*a*' is preferably fixed to an axial end face of the drive shaft 3 as illustrated in FIG. 2.

In the method and the passenger conveyor 1 according to invention, preferably the first sensing arrangement 5 for sensing a rotation speed of the motor 4 comprises one or more encoders. Different arrangements for sensing rotation speed of a motor are known and used. One widely known and used arrangements for sensing rotation speed of a motor comprises an encoder. The encoder can for instance comprise one or more sensors mounted on a stator of the motor and arranged to sense one or more features of the rotor of the motor 4, and to generate and send a signal to the control system, every time a feature to be sensed passes by it. The encoder is preferably arranged to generate and send signals to the control system 12 indicating rotation speed of the motor 4. The signals of the encoder generated and sent to the control system 12 have preferably frequency proportional to the rotation speed of the motor 4.

Figure 5:
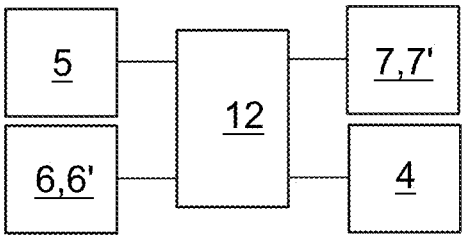
FIG. 5 illustrates preferred connections between the first sensing arrangement, the second sensing arrangement, the brake and the motor of the passenger conveyor of FIG. 1.

As illustrated in FIG. 5, it is preferable that the control system 12 is connected with the first sensing arrangement 5, the second sensing arrangement 6, for receiving signals from them, and with the brake 7,7' and the motor 4 for sending control signals to them.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A method for controlling a passenger conveyor, the passenger conveyor comprising:

an endless band of conveying elements, the endless band comprising an inclined conveying section;

a transmission;

a drive shaft connected to the transmission and arranged to drive the endless band of conveying elements when rotated;

a motor including an output shaft connected to the transmission, wherein rotation of the output shaft causes rotation of the drive shaft, via the transmission;

a first sensing arrangement for sensing a rotation speed of the motor;

a brake activatable to act directly on the drive shaft or an element directly fixedly connected to the drive shaft for stopping rotation of the drive shaft; and a control system, wherein the method comprises:

operating the motor to cause rotation of the output shaft and rotation, via the transmission, of the drive shaft; and sensing a rotation speed of the motor with the first sensing arrangement, wherein the passenger conveyor comprises a second sensing arrangement engaging the drive shaft, and wherein the method further comprises:

sensing the rotation speed of the drive shaft with the second sensing arrangement;

detecting a deviation meeting a predefined criteria between the rotation speed of the motor and the rotation speed of the drive shaft or a multifold thereof; and activating the brake for stopping the rotation of the drive shaft if the deviation is detected between the rotation speed of the motor and the rotation speed of the drive shaft or a multifold thereof, wherein said multifold equals to the rotation speed of the drive shaft multiplied with a preset factor n, wherein n equals to a transmission ratio between the drive shaft and the motor.

2. The method according to claim 1, wherein said detecting comprises comparing a frequency of the motor with a frequency of the drive shaft.

3. The method according to claim 1, wherein said detecting comprises obtaining said frequency of the motor and the frequency of the drive shaft from signals received from the first sensing arrangement and the second sensing arrangement, respectively.

4. The method according to claim 1, wherein the method further comprises stopping the rotation of the motor if the deviation is detected between the rotation speed of the motor and the rotation speed of the drive shaft or a multifold thereof.

5. A passenger conveyor comprising:

an endless band of conveying elements, the endless band comprising an inclined conveying section;

a transmission;

a drive shaft connected to the transmission and arranged to drive the endless band of conveying elements when rotated;

a motor including an output shaft connected to the transmission, wherein rotation of the output shaft causes rotation of the drive shaft, via the transmission;

a first sensing arrangement for sensing a rotation speed of the motor;

a brake activatable to act directly on the drive shaft or an element directly rigidly fixed on the drive shaft for stopping rotation of the drive shaft;

a control system; and a second sensing arrangement engaging the drive shaft for sensing a rotation speed of the drive shaft, wherein the control system is configured to detect a deviation meeting a predefined criteria between the rotation speed of the motor and the rotation speed of the drive shaft or a multifold thereof, and to activate the brake for stopping rotation of the drive shaft if the deviation is detected between the rotation speed of the motor and the rotation speed of the drive shaft or a multifold thereof, wherein said multifold equals to the rotation speed of the drive shaft multiplied with a preset factor n, wherein n equals to a transmission ratio between the drive shaft and the motor.

6. The passenger conveyor according to claim 5, wherein the control system is configured to compare a frequency of the motor with a frequency of the drive shaft for detecting said deviation.

7. The passenger conveyor according to claim 5, wherein the control system is configured to stop the rotation of the motor if the deviation is detected between the rotation speed of the motor and the rotation speed of the drive shaft or a multifold thereof.

8. The method according to claim 1, wherein the transmission comprises one or more gear wheels and/or a drive chain for transmitting rotation between the output shaft of the motor and the drive shaft.

9. The method according to claim 1, wherein the element fixedly connected with the drive shaft is a wheel coaxial with the drive shaft.

10. The method according to claim 9, wherein said wheel fixedly connected with the drive shaft is a drive wheel rotatable by the drive shaft, and arranged to drive the endless band when rotated, or said wheel fixedly connected with the drive shaft is a braking wheel, fixedly connected with the drive shaft in addition to a pair of drive wheels.

11. The method according to claim 9, wherein the brake is a gripping device actuatable to grip said wheel fixedly connected with the drive shaft for stopping rotation thereof.

12. The method according to claim 1, wherein, the second sensing arrangement is arranged to generate and send to the control system signals having a frequency proportional to the rotation speed of the drive shaft.

13. The method according to claim 1, wherein the second sensing arrangement for sensing a rotation speed of the drive shaft comprises one or more encoders.

14. A method for controlling a passenger conveyor, the passenger conveyor comprising:

an endless band of conveying elements, the endless band comprising an inclined conveying section;

a drive shaft arranged to drive the endless band of conveying elements when rotated;

a motor for rotating the drive shaft;

a first sensing arrangement for sensing a rotation speed of the motor;

a brake activatable to act directly on the drive shaft or an element fixedly connected to the drive shaft for stopping rotation of the drive shaft; and a control system, wherein the method comprises:

rotating the drive shaft with the motor; and sensing a rotation speed of the motor with the first sensing arrangement, wherein the passenger conveyor comprises a second sensing arrangement for sensing a rotation speed of the drive shaft, wherein the method comprises:

sensing the rotation speed of the drive shaft with the second sensing arrangement;

detecting a deviation meeting a predefined criteria between the rotation speed of the motor and the rotation speed of the drive shaft or a multifold thereof; and activating the brake for stopping the rotation of the drive shaft if the deviation is detected between the rotation speed of the motor and the rotation speed of the drive shaft or a multifold thereof, wherein said multifold equals to the rotation speed of the drive shaft multiplied with a preset factor n, wherein n equals to a transmission ratio between the drive shaft and the motor, and wherein the second sensing arrangement comprises a rotatable member engaging the drive shaft such that the rotatable member is rotatable by the drive shaft.

15. The method according to claim 14, wherein the rotatable member is connected to the drive shaft such that they share a rotational axis, the rotatable member being fixed to an axial end face of the drive shaft.

16. The method according to claim 14, wherein the rotatable member is a wheel leaning against a rim of the drive shaft, the rotational axis of said wheel and the rotational axis of said shaft extending parallel at a distance from each other, said wheel being a friction wheel frictionally engaging the rim of the drive shaft.

17. The method according to claim 2, wherein said detecting comprises obtaining said frequency of the motor and the frequency of the drive shaft from signals received from the first sensing arrangement and the second sensing arrangement, respectively.

18. The method according to claim 2, wherein the method further comprises stopping rotation of the motor if the deviation is detected between the rotation speed of the motor and the rotation speed of the drive shaft or a multifold thereof.

19. The method according to claim 3, wherein the method further comprises stopping rotation of the motor if the deviation is detected between the rotation speed of the motor and the rotation speed of the drive shaft or a multifold thereof.

20. The passenger conveyor according to claim 6, wherein the control system is configured to stop rotation of the motor if the deviation is detected between the rotation speed of the motor and the rotation speed of the drive shaft or a multifold thereof.

* * * * *